United States Patent [19]

Landsberg

[11] 4,051,767

[45] Oct. 4, 1977

[54] ACTUATOR FOR FLUID PRESSURE-OPERATED POWER DEVICES

[76] Inventor: Dieter Landsberg, Riemenschneiderstrasse 17, 4041 Allerheiligen, Germany

[21] Appl. No.: 596,782

[22] Filed: July 17, 1975

[51] Int. Cl.[2] ..... F15B 13/042

[52] U.S. Cl. ..... 91/420; 91/446; 91/448; 91/467; 137/119; 137/624.18

[58] Field of Search ..... 91/420, 442, 447, 40, 91/468, 446, 448, 466, 467; 137/624.18, 624.14, 625.6, 625.66, 119

[56] References Cited

U.S. PATENT DOCUMENTS

| | | | |
|---|---|---|---|
| 2,678,845 | 5/1954 | Fitter | 137/624.14 X |
| 3,010,433 | 11/1961 | Codling | 91/443 |
| 3,018,788 | 1/1962 | Perlis | 137/624.11 X |
| 3,319,531 | 5/1967 | Sanders | 91/467 X |
| 3,369,565 | 2/1968 | Haggard, Jr. | 137/624.18 X |
| 3,402,553 | 9/1968 | Mercier | 91/462 X |
| 3,459,208 | 8/1969 | Clyde | 137/624.14 X |
| 3,785,391 | 1/1974 | Miller | 137/624.14 X |

FOREIGN PATENT DOCUMENTS

| | | | |
|---|---|---|---|
| 1,333,105 | 10/1973 | United Kingdom | 137/119 |
| 226,244 | 1/1969 | U.S.S.R. | 137/119 |

*Primary Examiner*—Irwin C. Cohen
*Attorney, Agent, or Firm*—Spencer & Kaye

[57] ABSTRACT

A system for supplying pressurized fluid from a pressure source to a fluid-operated power device comprises an actuator, a sole first pressure conduit leading from the source to the actuator and at least two second pressure conduits leading from the actuator to the power device. The actuator comprises a cylinder and a piston arranged for simultaneous reciprocation and rotation in the cylinder. The reciprocation of the piston is effected by the fluid pressure introduced periodically into the cylinder through the first pressure conduit. The rotation of the piston is effected by the cooperation of a pin affixed to the cylinder wall with a helically extending groove in the cylindrical piston face. The piston is provided with a duct arrangement which, coordinated with the course of the groove, is laid out in such a manner that as the piston consecutively arrives in its end position, upon completing a forward stroke in response to the fluid pressure, always a different one of the second pressure conduits is supplied with the fluid pressure from the first pressure conduit through the duct arrangement in the piston.

2 Claims, 6 Drawing Figures

ACTUATOR FOR FLUID PRESSURE-OPERATED POWER DEVICES

BACKGROUND OF THE INVENTION

This invention relates to an actuator for fluid pressure-operated motors, particularly pneumatically operated setting devices.

Setting devices of the above-outlined type, particularly power cylinders, control cylinders, valves or the like have been used for a long time in measuring and control systems for measuring pressure, temperature or material quantities, for electromechanical processes, for indicating and controlling contents in silos and containers, for throttle devices, vane guides, flaps, etc.

In the above applications, the setting devices are in general coupled through a switch valve with the supply circuit (hereinafter also referred to as pressure source) of the pressurized medium. In such an arrangement it is necessary that the setting device (for example, a double-acting power cylinder) be connected to the pressure source by means of at least two conduits. Each of these two conduits serves for separately pressurizing the two oppositely oriented radial end faces of the piston disposed in the cylinder and/or for the introduction and withdrawal of the pressure medium which is usually a gas but which may also be a liquid.

Systems and devices of the above-outlined type are disclosed, for example, in French Pat. Nos. 2,115,506 and 2.201,406, U.S. Pat. Nos. 3,727,639 and 3,754,400 as well as in the German Laid-Open Application (Offenlegungsschrift) No. 1,916,266.

It is a common characteristic of all of the above known systems, devices or circuits that the setting device or, as the case may be, the setting members are in direct communication with the pressure source (such as a pump or a fan or the like) by a separate supply conduit and a return conduit or by two pressure conduits. The supply and return conduits, together with the setting device and the source for the pressure medium form a closed circuit, as it may be observed, for example, in French Pat. No. 2,115,506 (FIG. 1, conduits 30 and 32).

In practice, pneumatically operated setting components are, for operational reasons, in most cases disposed at a significant distance from the main circuit of the pressure medium.

Particularly in case of systems which operate with a plurality of pneumatically driven setting members, such as measuring or control centers of refineries, steam generating or cooling water systems in power plants, large capacity silos, nuclear plants, aerating systems in schools, storehouses, etc., the pressurized fluid is almost always drawn from a main supply network and the setting members are in most cases disposed at locations which are not easily accessible. For these reasons, there are needed substantial amounts of conduits for the purpose of bridging, by means of a double conduit, the distance, for example, from the main pressure network through the control station to the setting member. For this reason, plants like oil refineries, petro-chemical plants, cold storage buildings, large-capacity heating arrangements and the like very often need hundreds or even thousands of meters of double conduits.

Apart from the need for a substantial material and labor input with regard to such double conduits, the probability that defects and breakdowns occur along the conduits is doubled. This substantial risk, coupled with additional required maintainance projects thus have to be considered as true disadvantages in the systems of the above-outlined type and consequently are to be looked upon as an operational problem of prime importance.

If, for example, in a system according to French Pat. No. 2,115,506 there are arranged, adjacent to one another, four setting members at a location which is accessible only with difficulty, according to the presently known methods — despite the proximity of the setting members — all four setting members are separately connected with the supply network for the medium by means of their own dual conduit.

Since the supply network (main conduit) for the pressurized fluid is supported in most cases on a pipe or conduit bridge which almost always extends centrally through the hall or centrally with respect to the system disposed in open air and since between the supply conduit and the setting member, apart from an energizing element, in most cases there is a central switching station, the dual conduits serving the system tend, in their totality, to create visual confusion.

SUMMARY OF THE INVENTION

It is an object of the invention to provide for fluid pressure-operated power devices, an improved pressure supply system from which the above-explained disadvantages are eliminated.

This object and others to become apparent as the specification progresses, are accomplished by the invention, according to which, briefly stated, the system for supplying pressurized fluid from a pressure source to a fluid-operated power device comprises an actuator, a sole first pressure conduit leading from the source to the actuator and at least two second pressure conduits leading from the actuator to the power device. The actuator comprises a cylinder and a piston arranged for simultaneous reciprocation and rotation in the cylinder. The reciprocation of the piston is effected by the fluid pressure introduced periodically into the cylinder through the first pressure conduit. The rotation of the piston is effected by the cooperation of a pin affixed to the cylinder wall with a helically extending groove in the cylindrical piston face. The piston is provided with a duct arrangement which, coordinated with the course of the groove, is laid out in such a manner that as the piston consecutively arrives in its end position upon completing a forward stroke in response to the fluid pressure, always a different one of the second pressure conduits is supplied with the fluid pressure from the first pressure conduit through the duct arrangement in the piston.

By means of the above-outlined design of the actuator, the latter can control a desired number of setting members, while between the actuator and the supply network for the pressure medium there is needed only a sole control pressure conduit, so that dual conduits are no longer necessary there.

Thus, in its entirety, the apparatus according to the invention comprises a sole conduit for the admission and withdrawal of the fluid between the supply network and the actuator, an energizing element (such as a switch valve) of known structure for allowing the pressurized fluid to be admitted from the pressure supply (pressure source) to the sole conduit and an actuator which has a specific structure and operation.

The actuator is disposed as close to the setting members as possible. In this manner the supply and return conduits which extend between the actuator and the setting members and which, in any event, are only a few centimeters or only a fraction of a meter long, may be further shortened.

In case a sole setting member is used, the latter is expediently mounted directly on the actuator so that in most cases the length of the connecting dual conduit has to be only a few centimeters long.

According to one embodiment of the invention, the duct arrangement in the piston of the actuator is formed of an axial bore and at least two axially spaced radial channels extending from the axial bore to the cylindrical piston surface. The channels are angularly set off with respect to one another.

As the piston rotates upon executing its axial motion, the radial channels (first embodiment) or the groove in the radial piston face (second embodiment) register with different ports which are provided in the cylinder wall and to which the pressure conduits leading to the power device are attached.

DESCRIPTION OF THE PREFERRED EMBODIMENTS

Figure 1B:
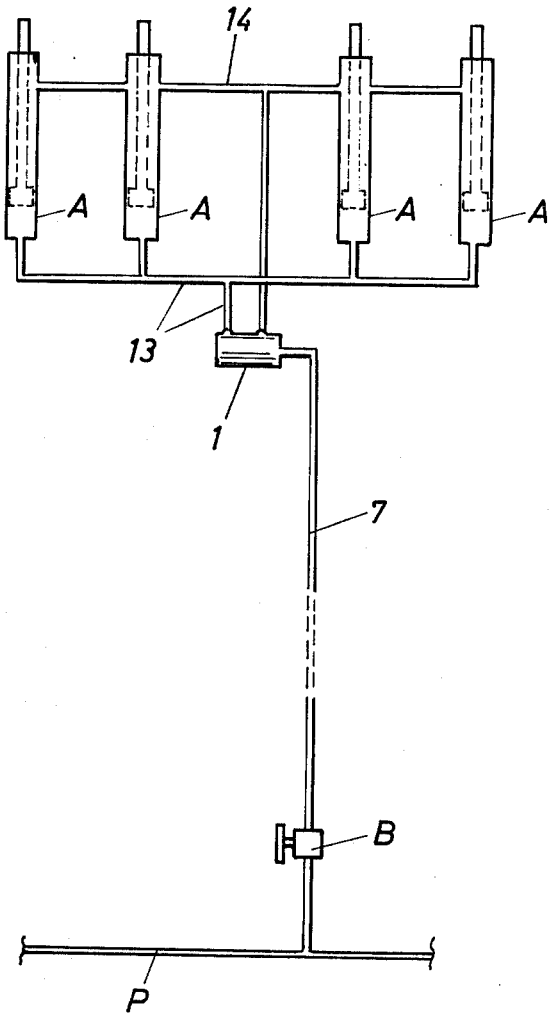
FIG. 1*b* is a schematic diagrammatic view of a fluid pressure-operated power system including four setting members and incorporating the invention.
Figure 1A:
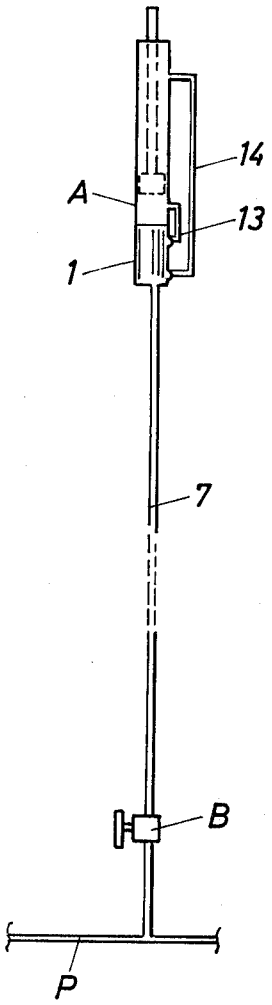
FIG. 1*a* is a schematic diagrammatic view of a fluid pressure-operated power system including a sole setting member and incorporating the invention.

Turning now to FIG. 1*a*, a double-acting power cylinder A, for example, a pneumatically operated setting device, has two work chambers on one and the other side of the setting piston. The two work chambers are connected, by means of separate, short pressure conduits 13 and 14, to an actuator 1 which is mounted directly at one end of the power cylinder A. The actuator is connected by a sole pressure conduit 7 to a source P supplying a pressurized fluid. Admission of the fluid from the source to the conduit 7 or drainage of the fluid from the actuator 1 through the conduit 7 is controlled by a conventional switching valve B disposed between the conduit 7 and the pressure source P.

FIG. 1*b* illustrates an arrangement similar to FIG. 1*a*, except that here there are provided a plurality of power cylinders A, the corresponding work chambers of which are connected in parallel by the conduits 13 and 14, respectively.

As seen in FIGS. 1*a* and 1*b*, the actuator 1 may be arranged in a close vicinity of the setting members A and in case there is provided only a single setting member, the actuator may be directly attached thereto. In this manner, the conduits 13 and 14 are shortened to the utmost and, for all practical purposes, are of negligible length. The conduit 7 which represents by far the longest element of the pressure supply system, is, as indicated above, a single-path structure.

Figure 2:
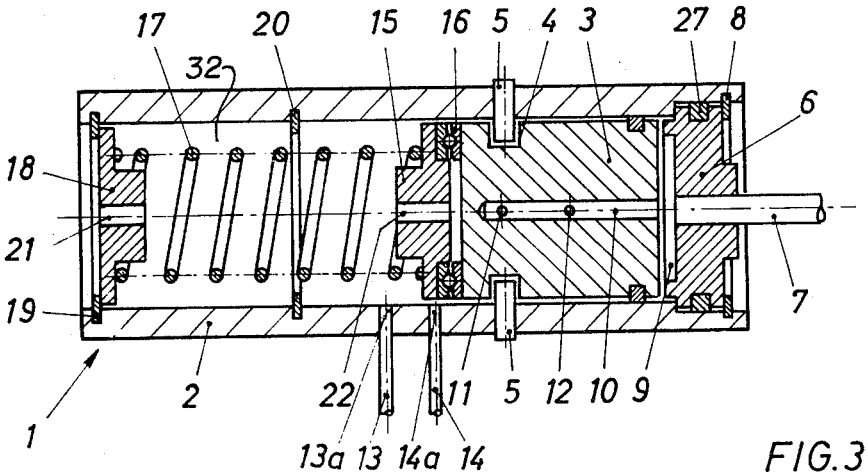
FIG. 2 is a longitudinal sectional view of a preferred embodiment of an actuator, shown in its position of rest.
Figure 3:
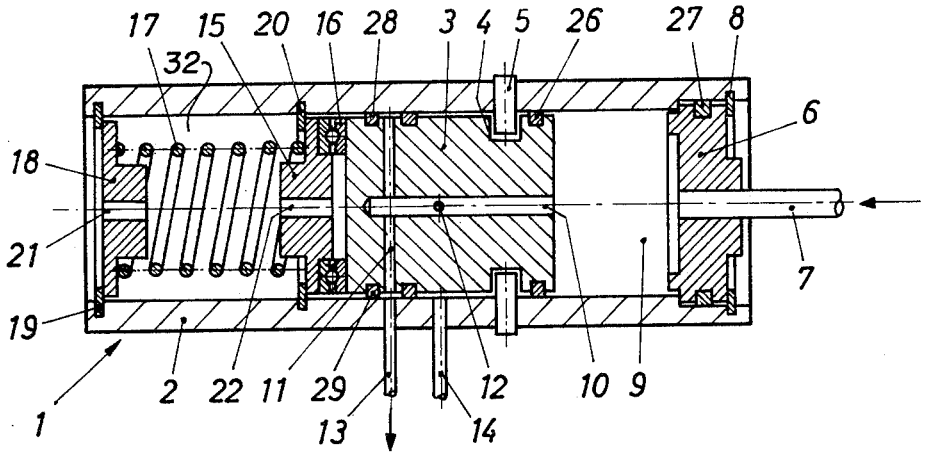
FIG. 3 is a longitudinal sectional view of the same embodiment, shown in a first routing position.
Figure 4:
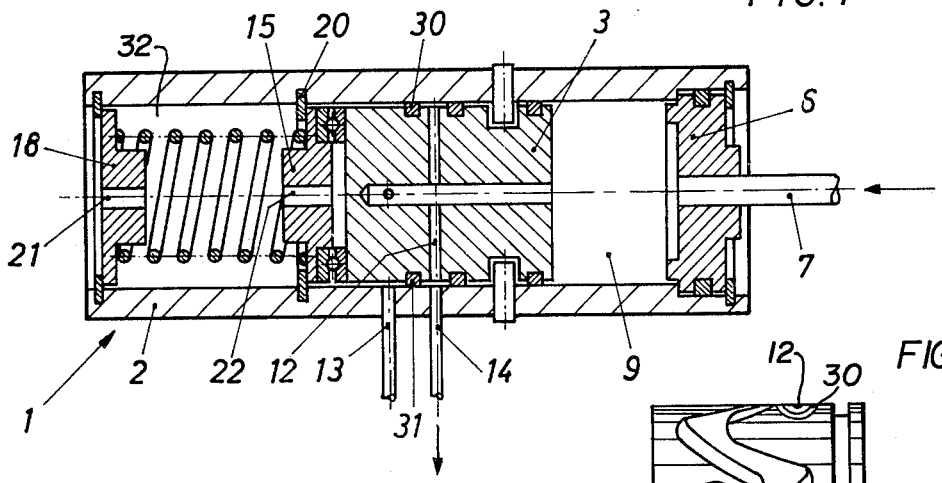
FIG. 4 is a longitudinal sectional view of the same embodiment, shown in a second routing position.

Turning now to FIGS. 2, 3 and 4, there is shown a preferred embodiment of the actuator 1. It comprises a cylinder 2 in which there is movably arranged a piston 3. Also referring to FIG. 5, on its cylindrical surface the piston 3 is provided with a helically extending, continuous groove 4 into which project pins 5 secured to the wall of the cylinder 2. The conduit 7 extends through a radial closure member 6 of the cylinder 2 and opens into a frontal pressure chamber 9 bounded by the cylinder wall, the closure 6 and a radial face of the piston 3. Between the closure member 6 and the cylinder 2 there is disposed a packing ring 8.

The piston 3 is provided with an axial blind bore 10 which opens into the pressure chamber 9 and which communicates with the cylindrical surface of the piston 3 by means of axially spaced and angularly offset radial channels 11 and 12.

In the wall of the cylinder 2 there are provided axially spaced ports 13*a*, 14*a*, to which the respective conduits 13 and 14 are attached and through which these conduits communicate with the inside of the cylinder 2. The axial spacing between the ports 13*a* and 14*a* corresponds to that between the channels 11 and 12; the number of these channels, in turn, depends on the number of conduits which, in this example, is two (13 and 14). It is further noted — as may be observed in FIGS. 3 and 4 — that in this example each channel 11 and 12 extends diametrically, that is, in opposite radial directions from the bore 10. As will be apparent from the description of the operation, it may be sufficient if each channel 11 or 12 extends only in one radial direction from the bore 10 to the outer cylindrical surface of the piston 3.

Figure 5:
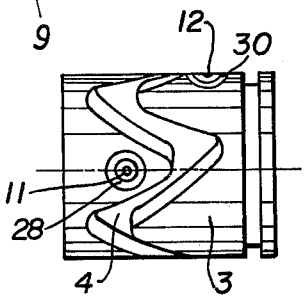
FIG. 5 is a side elevational view of a component of the same embodiment.

By means of O-rings 26 and 27 the piston 3 and the cylinder closure 6, respectively, sealingly engage the inner wall of the cylinder 2. Similar seals are provided at locations 28, 29, 30 and 31 of the piston 3. Thus, more specifically, the O-rings 26 and 27 which are concentric with the axis of the cylinder 2 as seen in FIGS. 2, 3 and 4, seal the pressure chamber 9 from the environment as well as from the axial bore 21 (venting port). Further, the annular seal 28 entirely surrounds the opening of the one leg of the duct 11 (as seen in FIGS. 3 and 5), while the annular seal 29 entirely surrounds the opening of the other leg of the duct 11 (FIG. 3). Similarly, the annular seal 30 entirely surrounds the opening of one leg of the duct 12 (FIGS. 4 and 5), while the annular seal 31 entirely surrounds the opening of the other leg of the duct 12 (FIG. 4).

Between the piston 3 and a pressure plate 15 disposed axially adjacent the piston 3, there is provided a ball bearing 16 which ensures a low-friction rotary motion of the piston 3 with respect to the pressure plate 15. The pressure plate 15 itself is urged against the piston 3 by means of a compression spring 17 disposed in an exhaust chamber 32 defined by the cylinder 2 and separated from the pressure chamber 9 by the piston 3. The compression spring 17 is supported by a radial closure 18 which is secured to the cylinder 2 by means of a snap ring 19. Thus, the spring 17 continuously urges the piston 3 to reduce the volume of the pressure chamber 9. In the wall of the cylinder 2 there is held an abutment ring 20 which serves for limiting the stroke of the piston 3 and the pressure plate 15 in a direction that opposes the force of the spring 17. The pressure plate 15 and the closure 18 are provided with throughgoing axial bores (exhaust ports) 22 and 21, respectively, communicating with the exhaust chamber 32.

In the description that follows, one operational cycle of the above-described actuator 1 will be set forth.

Initially, the switch valve B is so set that the conduit 7 is depressurized and thus there is no operational fluid pressure in the pressure chamber 9 of the cylinder 2. As a result, as it may be observed in FIG. 2, the piston 3, urged by the spring 17, assumes its position of rest at the right-hand side of the cylinder 2.

If now the switch valve B is, by appropriate means — which do not form part of the invention — brought into its "energizing" position, pressurized fluid is admitted from the pressure source P to the conduit 7, whereby pressure is built up in the pressure chamber 9. This pressure eventually overcomes the force of the spring 17 and, as a result, the piston 3 is displaced towards the left, against the force of the spring 17, until the pressure plate 15 is stopped by the abutment ring 20. This completes the forward stroke of the piston 3. During this stroke, by virtue of the cooperation of the stationary guide pins 5 with the helically extending groove 4 provided in the outer, cylindrical face of the piston 3, the latter, simultaneously with its axial motion, executes a rotary motion about its axis, to an extent determined by the course (pitch) of the groove 4. As a result of this rotation, one radial leg of the channel 11 arrives into registry with the port 13*a* as the piston reaches the end of its forward stroke. This position of the piston 3 is illustrated in FIG. 3. As a result of this position, the fluid pressure in the pressure chamber 9 is now admitted to the conduit 13 through the axial bore 10 and one radial leg of the channel 11. Thus, of the two control conduits 13 and 14 provided in this exemplary structure, the conduit 13 is pressurized. In view of the exemplary hookup shown in FIG. 1*b,* as a result of the pressurization of the conduit 13, the pistons of all four setting devices A will move upwardly.

The above operational stage, that is, the pressurization of the conduit 13, will be maintained as long as the conduit 7 is maintained continuously pressurized.

If now the switch valve B is caused to change its position so that communication between the conduit 7 and the pressure source P is blocked and, in addition, the pressurized fluid in the conduit 7 is allowed to be drained, in the pressure chamber 9 the fluid pressure will drop. As a result, the spring 17 can now cause the piston 3 to execute its return stroke, at the end of which the piston 3 assumes its initial axial position as shown in FIG. 2. By virtue of the cooperation between pins 5 and the groove 4, the piston 3, during its return stroke, again executed a rotary motion in the same direction as during the forward stroke.

Upon subsequent pressurization of the conduit 7 by changing again the position of the switch valve B, a new forward stroke of the piston 3 will be executed with a simultaneous rotary motion, again in the same direction. At the end of this second forward stroke the piston will assume the same axial position as in FIG. 3, but a different angular position, as it may be well seen in FIG. 4. As shown in FIG. 4, it is now one radial leg of the channel 12 which is in alignment with the port 14*a.* As a result, the fluid pressure in the pressure chamber 9 is now admitted to the conduit 14 through the axial bore 10 and one radial leg of the channel 12. As a result, in the system illustrated in FIG. 1*b,* all the setting devices A will simultaneously be urged downwardly because of the simultaneous pressurization of all of the upper chambers through the conduit 14. It is noted that the pressurized fluid from the now inactive lower chambers may be vented through the conduit 13 and the ports 21, 22 provided in the cylinder 2.

Thus, when the piston 3 is in the position shown in FIG. 3, the conduit 13 is pressurized, while the conduit 14 can vent the contracting chamber of the fluid motor A through the exhaust chamber 32 and the port 21 via the passage between the wall of the piston 3 and the wall of the cylinder 2. Likewise, when the piston 3 is in the position shown in FIG. 4, the conduit 14 is pressurized, while the conduit 13 can vent the other contracting chamber of the fluid motor A through the exhaust chamber 32 and the port 21 via the passage between the walls of the piston 3 and the cylinder 2. When the piston 3 is in the position shown in FIG. 2, the ports 13*a* and 14*a* associated with the conduits 13 and 14, respectively, communicate with the exhaust chamber 32. When the piston 3 is in a forward position as shown in FIG. 3 or 4, always that port 13*a* or 14*a* communicates with the exhaust chamber 32 which is not then in communication with the pressure chamber 9.

Each device A is, in essence, a fluid motor which executes reciprocating motions in response to the alternating pressurization and depressurization of the conduits 13 and 14.

One operational cycle is terminated as the piston 3 has executed a further return stroke and rotation upon further actuation of the switch valve B and a depressurization of the pressure chamber 9.

It is thus seen that by means of the alternating pressurization and depressurization of the sole conduit 7 a sequential (alternating) pressurization of the conduits 13 and 14 was accomplished each time the piston 3 completed its forward stroke and this pressurization maintained as long as the piston 3 dwelled in its forwardmost position. A rotation of the piston, due to the selected course of the groove 4 occurs upon every axial displacement (forward or return stroke) of the piston 3 and the rotation occurs always in the same direction.

It is noted that in the structural example described and illustrated in FIGS. 2–4 the channels 11 and 12 each have two radially oppositely extending legs. Thus, in this example, the course of the groove 4 may be so designed that upon every stroke (forward stroke or return stroke) the piston 3 executes a 45° turn. It would be feasible to provide — again for the purpose of serving two conduits 13 and 14 — only a single radial leg of channels 11 and 12. Such channels would then be offset 180° with respect to one another and the piston would rotate through an angle of 90° during each stroke.

The number of conduits to be sequentially served by the actuator 1 may be arbitrarily selected up to a structurally determined limit. Thus, for example, instead of only two conduits 13 and 14 one could use six such conduits in which case there would be provided six axially spaced ports in the wall of the cylinder 2, similar to the ports 13*a* and 14*a.* Accordingly, in such a case, there would be provided, in the piston 3, six radially extending, axially spaced channels, expediently with a 60° offset. Further, the course of the helical groove in the cylindrical wall of the piston 3 would now be so designed that during each stroke the piston executes a 30° turn. As a result, every time the piston arrives in an abutting relationship with the ring 20, it assumes an angular position which is 60° offset with respect to the previous operational position. Consequently, each time the piston 3 completes a forward stroke, the fluid pressure in the pressure chamber 9 will be admitted through the bore 10 to another one of the six conduits by virtue of the sequential alignment of the radial channels with consecutive ports in the cylinder wall.

It will be understood that the above description of the present invention is susceptible to various modifications, changes and adaptations, and the same are intended to be comprehended within the meaning and range of equivalents of the appended claims.

What is claimed is:

1. In a system including a fluid motor means; means for supplying pressurized fluid from a pressure source to energize the fluid motor means; a switch means having a first switching state in which pressurized fluid is introduced from the pressure source to the system and a second switching state in which communication is blocked between the pressure source and the system and the system is depressurized; the improvement comprising a. a sole first pressure conduit having a first end and a second end; said first end being connected to the pressure source with the interposition of said switch means;

b. an actuator including 1. a cylinder having a cylindrical wall defining a pressure chamber to which said second end of said first pressure conduit is connected and an exhaust chamber;
2. at least two coupling ports provided in said cylindrical wall; said ports being axially spaced from one another;
3. a guide pin secured to said cylindrical wall and projecting into a space bounded by said cylindrical wall;
4. a piston disposed in said cylinder with a close fit and arranged for axial and angular displacement; said piston having a cylindrical lateral surface and a radial end face which bounds said pressure chamber; said piston separating said pressure chamber from said exhaust chamber in a fluid-tight manner by a first sealing means carried by said piston; said piston having a first axial position and a second axial position;
5. means defining a passage between the cylindrical wall of said cylinder and the cylindrical lateral surface of said piston;
6. pressing means urging said piston in said first axial position; said piston being moved into said second axial position by the pressurized fluid when admitted into said pressure chamber from said pressure source through said first pressure conduit; said piston being moved into said first position by said pressing means upon depressurization of said pressure chamber;
7. means defining a helically extending groove in the piston surface; said guide pin projecting into said groove for effecting a rotary motion of predetermined angle of said piston during axial movement of said piston from one of its positions into the other;
8. a bore extending into said piston from said radial end face;
9. axially spaced channels provided within said piston; said channels starting at said bore and terminating at said cylindrical lateral surface of said piston; said channels establishing communication between said pressure chamber and a selected one of said ports when said piston is in said second position; the magnitude of the predetermined angle being such that upon each successive arrival of said piston into said second position a different one of said ports communicates with said pressure chamber; in said first axial position of said piston each said coupling port is in communication with said exhaust chamber through said passage and in said second axial position of said piston each said coupling port other than that pressurized from said pressure chamber is in communication with said exhaust chamber through said passage;
10. second sealing means carried by said piston and individually surrounding the mouth of each said channel on said cylindrical lateral surface of said piston; said second sealing means being in engagement with the cylindrical wall of said cylinder for blocking communication, in said second axial position of said piston, between said exhaust chamber and any coupling port pressurized from said pressure chamber; and c. second pressure conduits equalling the number of said ports; a separate one of said second pressure conduits being connected, at one end, to a separate one of said ports and, at another end, to said fluid motor means.

2. A system as defined in claim 1, wherein said bore extends axially and said channels extend radially with respect to said piston.

* * * * *